US007594386B2

(12) United States Patent
Narayanan et al.

(10) Patent No.: US 7,594,386 B2
(45) Date of Patent: Sep. 29, 2009

(54) APPARATUS FOR THE PREVENTION OF CRITICAL PROCESS VARIABLE EXCURSIONS IN ONE OR MORE TURBOMACHINES

(75) Inventors: Krishnan Narayanan, West Des Moines, IA (US); Paul F Fisher, West Des Moines, IA (US)

(73) Assignee: Compressor Controls Corporation, Des Moines, IA (US)

( * ) Notice: Subject to any disclaimer, the term of this patent is extended or adjusted under 35 U.S.C. 154(b) by 301 days.

(21) Appl. No.: 11/427,515

(22) Filed: Jun. 29, 2006

(65) Prior Publication Data

US 2006/0283169 A1 Dec. 21, 2006

Related U.S. Application Data

(62) Division of application No. 10/756,538, filed on Jan. 13, 2004, now Pat. No. 7,096,669.

(51) Int. Cl.
*F02C 9/00* (2006.01)
*F01D 17/00* (2006.01)

(52) U.S. Cl. ..... 60/39.24; 415/13

(58) Field of Classification Search ..... 415/13, 415/26, 27; 60/39.24, 794, 795; 417/1
See application file for complete search history.

(56) References Cited

U.S. PATENT DOCUMENTS 3,937,588 A * 2/1976 Kisslan ..... 415/17
4,142,838 A 3/1979 Staroselsky
4,341,071 A * 7/1982 Abo et al. ..... 60/790
4,486,142 A 12/1984 Staroselsky
4,827,937 A 5/1989 Kohler
4,949,276 A 8/1990 Staroselsky
5,609,465 A 3/1997 Batson
5,709,526 A 1/1998 McLeister
6,236,183 B1 * 5/2001 Schroeder ..... 318/721
6,792,760 B2 9/2004 Mathias

OTHER PUBLICATIONS

Pp. 75-79 from a Series 3 Plus Antisurge Controller—for Axial and Centrifugal Compressors Manual by Compressor Controls Corporation—dated Feb. 1999.
Pp. 82-88 from a Series 3 Plus Antisurge Controller—for Axial and Centrifugal Compressors Manual by Compressor Controls Corporation—dated Feb. 1999.
Pp. 83-84 from a Series 3 Plus Speed Controller for Steam Turbines Manual by Compressor Controls Corporation—dated Feb. 2001.

* cited by examiner

*Primary Examiner*—Louis J Casaregola
(74) *Attorney, Agent, or Firm*—Sturm & Fix LLP

(57) ABSTRACT

Many variables in processes such as those using turbocompressors and turbines must be limited or constrained. Limit control loops are provided for the purpose of limiting these variables. By using a combination of closed loop and open loop limit control schemes, excursions into unfavorable operation can be more effectively avoided. Transition between open loop and closed loop may be enhanced by testing the direction and magnitude of the rate at which the limit variable is changing. If the rate of change indicates recovery is imminent, control is passed back to the closed loop limit control function.

15 Claims, 9 Drawing Sheets

APPARATUS FOR THE PREVENTION OF CRITICAL PROCESS VARIABLE EXCURSIONS IN ONE OR MORE TURBOMACHINES

CROSS REFERENCE TO RELATED APPLICATIONS

This application is a Divisional of U.S. patent application Ser. No. 10/756,538 filed Jan. 13, 2004, entitled METHOD AND APPARATUS FOR THE PREVENTION OF CRITICAL PROCESS VARIABLE EXCURSIONS IN ONE OR MORE TURBOMACHINES which is incorporated herein by reference in its entirety.

STATEMENT REGARDING FEDERALLY SPONSORED RESEARCH OR DEVELOPMENT

Not Applicable.

REFERENCE TO MICROFICHE APPENDIX

Not applicable.

BACKGROUND OF THE INVENTION

1. Field of the Invention

The present invention relates to a control scheme. More particularly the present invention relates to a method and apparatus for more accurately and stably limiting critical variables associated with a process such as those including turbomachines such as a turbocompressor, steam turbine, gas turbine, or expander.

2. Background Art

The safe operating regime of a turbocompressor is constrained by the machinery and process limitations. A turbine-driven turbocompressor is generally bound by upper and lower limits of a turbine operating speed, a surge line, a choke limit, high discharge or low suction pressure bounds, and/or a power rating of the turbine. Limit control is used to keep the turbocompressor from entering an operating regime that is not considered safe, is unacceptable from a process standpoint, or undesirable for any reason. Limit control, also referred to as constraint control, is defined as a control strategy that will take action to avoid operating in these undesirable operating regimes, but only takes action when there is a tendency or danger of operating therein. Take, for example, a turbocompressor's discharge pressure that is to be constrained to remain at or below a set point, $p_{sp}$. When the turbocompressor's discharge pressure is below $p_{sp}$, no particular action is taken by the limit control system to adjust $p_{sp}$. Only when the turbocompressor's discharge pressure reaches or exceeds $p_{sp}$ is control action taken. Limit control strategies differ from ordinary control strategies in that: ordinary control strategies take measures to keep the process variable at its set point at all times (generally speaking), keeping the process variable from dropping below its set point as well as keeping it from exceeding its set point; limit control strategies are brought to bear only when a limit variable crosses its set point. On one side of its set point, the limit control scheme is not in effect.

Often, a rigid limit set point exists where a safety system, associated with the machinery or process, causes the machinery to shut down, or a relief valve to open, etc. The process control system, on the other hand, makes use of soft set points. A soft set point is separated from its associated rigid set point by a safety margin. Minimization of the safety margins results in an expanded operating envelope.

Advanced antisurge control systems have been applied very successfully in many applications to prevent the turbocompressor from damages due to surge. In U.S. Pat. No. 4,949,276, a method of antisurge control is disclosed using a speed of approach to surge to increase the safety margin. Once the compressor's operating point has reached the controller's surge control line, closed loop control attempts to prohibit surge by opening an antisurge valve. Open loop control is disclosed in U.S. Pat. Nos. 4,142,838 and 4,486,142. Here, an open loop control line is located toward surge from the surge control line. If closed loop control is unable to keep the compressor's operating point from reaching this open loop control line, an open loop control action will cause the antisurge valve to open as quickly as possible a predetermined increment.

A scheme similar to that just described for antisurge control was patented in U.S. Pat. No. 5,609,465 for overspeed control in turbines. Here, a steam valve is closed a predetermined increment as quickly as possible by an open loop control action.

Such advanced control schemes have not been applied for other constraints imposed on turbomachinery. Surge and overspeed are known to cause process upsets, but are somewhat unique in their ability to cause damage and destruction to the turbomachinery and adjacent equipment, and even to be dangerous to personnel. In the past, there was no motivation to apply these advanced techniques, along with their complexity, to other constrain control problems. In fact, common understanding taught that an open loop action would cause process upsets, thereby teaching away from the use of these advanced control schemes that resulted in what were considered severe reactions to process events causing a control action. Recently however, competitive conditions and political-economic-environmental issues such as the restriction on carbon dioxide emissions have resulted in reconsidering control strategies to squeeze the last percentage of efficiency from processes, and expand the operating envelope of the process as much as possible.

For instance, because of a process upset or a change in operating conditions, a turbocompressor's suction pressure may drop below atmospheric pressure, a condition that can cause air to be entrained in a hydrocarbon being compressed. Or the turbocompressor's interstage pressure may exceed a maximum pressure rating for the machinery casing or process vessels. Present-day control systems typically utilize a secondary-variable closed-loop control scheme to constrain the turbomachine's operating point within predetermined bounds. When a limit-control variable reaches its set point, control is bumplessly transferred from primary variable control to secondary variable limit control and the manipulated variable of the turbomachine is adjusted to bring and/or keep the offending limit-control variable within acceptable limits. Due to excessive dead times or large time constants in the overall system, traditional PID based constraint control actions may sometimes be inadequate to prevent an excursion of a critical process variable into a restricted region caused by a process upset. Moreover the set points configured for limit control are fixed. Therefore, limit control is initiated only if a variable crosses its predetermined limit, that is, a measurable error is incurred. Increasing the gains of the controller may not mitigate the problem due to the overall system's sluggishness (long dead times or large time constants). The best solution to this situation is to configure the control system with conservative safety margins. This invariably contracts the available operating zone of the turbocompressor. The consequence of such a control approach is a decrease in the turbocompressor's throughput with its associated significant impact on plant production.

There is, therefore, a need for a limit-control strategy that effectively and stably results in the constraining of limited variables, while bumplessly transferring between primary variable control and constraint variable control.

BRIEF SUMMARY OF THE INVENTION

A purpose of this invention is to provide a method and apparatus for limiting or constraining critical variables, herein referred to, generically, as "L," associated with a turbocompressor. Another purpose is to initiate limit-control action such that a limited variable does not cross its base set point. Still another purpose of the present invention is to carry out limit control and the transfer between primary variable control and limit control smoothly and stably.

Using a combination of closed loop and open loop responses, the limit-control action is designed to minimize the excursion of critical variables, L, related to a turbocompressor, turbine, expander or its associated process, beyond their set points.

Some examples of critical limit (constraint) variables, L, are turbocompressor suction, interstage, and discharge pressures, gas turbine exhaust gas temperature, gas and steam turbine power, machinery rotational speed, and various process pressures and temperatures. Antisurge control is, inherently, limit control, with the limit variable being a measure of a proximity to surge.

Fixing the set point for constraint control action can increase the overall response time of the control system. To circumvent this problem, the set point of the constraint-control loop is dynamically adjusted as a function of measurable process disturbances. Care must be taken to ensure that dynamic adjustment to the set point does not result in premature control actions on the manipulated variable (herein generically referred to as "M") that negatively influence the process. In a preferred embodiment, dynamic correction to the set point of each critical limit variable, L, is made as a function of the first derivative with respect to time, dL/dt, of that critical limit variable. In addition, these set point adjustments are rate limited and bound within acceptable levels in each direction (that is, increasing or decreasing) with the ability to configure independent rates and bounds as required.

An additional aspect of the present invention involves a fast acting, open loop, control response in the event the closed loop constraint control proves inadequate. An acceptable threshold of overshoot of a critical process variable measured from its defined constraint control set point is used as an indication of the effectiveness of closed loop action. Once the constrained variable has reached this overshoot threshold, a rapid change in the manipulated variable, M, is initiated to bring the constrained variable back to an acceptable value. This rapid alteration of the manipulated variable, M, is known as an "open loop" response. Specific methods of open-loop control action include a configurable step response, or fast ramp output to the manipulated variable. The open-loop output is adjusted for system dead time or hysteresis. The open loop control response may be repeated with appropriate pause between repetitions as needed to bring the operating point out of an undesirable state.

An additional indication of the effectiveness of closed loop action is to identify if a magnitude of a first temporal derivative of a critical process variable exceeds a configurable threshold.

Once the open-loop control response is found to be effective, the constraint-control action transitions over to closed loop control in a bumpless manner. A criterion such as a value of the critical process variable compared to its limit set point may be used to determine the point of switchover from open loop action to closed loop control. It is important to ensure that the switchover from open loop action to closed loop control not result in oscillations of the overall system as observed with traditional control systems. Such traditional systems typically employ high gains for constraint control action. In the preferred embodiment of this invention, this is realized by modifying the response of the open loop or closed loop in the return direction.

It is important to limit the suction pressure of turbocompressors handling explosive gases. Suction pressure limit-control applications of the present invention include: cracked gas turbocompressors in Ethylene plants, propylene or ethylene refrigeration turbocompressors in gas processing and Olefins plants, propane refrigeration compressors in LNG processes, wet gas compressors in Refineries, and Ammonia refrigeration compressors in fertilizer plants.

Interstage pressures may require limiting due to limitations on the machinery casing, or intercoolers or vessels located between stages. Applications for interstage pressure limit control are: fluidized catalytic cracking applications, cracked gas turbocompressors in Ethylene plants, pipe line gas turbocompressors, refrigeration turbocompressors in gas processing, and the turbocompressors used in LNG plants and Ammonia plants.

Turbocompressor discharge pressure may require limiting as well due to machinery casing or discharge process component limitations.

As mentioned above, there are two types of limit set points spoken of in process control. A rigid limit set point exists where a safety system, associated with the machinery or process, causes the machinery to shut down, or a relief valve to open, etc. The process control system, on the other hand, makes use of soft set points. A soft set point is separated from its associated rigid set point by a safety margin. In this application, only soft set points are of interest.

The novel features which are believed to be characteristic of this invention, both as to its organization and method of operation together with further objectives and advantages thereto, will be better understood from the following description considered in connection with the accompanying drawings in which a presently preferred embodiment of the invention is illustrated by way of example. It is to be expressly understood however, that the drawings are for the purpose of illustration and description only and not intended as a definition of the limits of the invention.

DETAILED DESCRIPTION OF THE INVENTION

Figure 1:
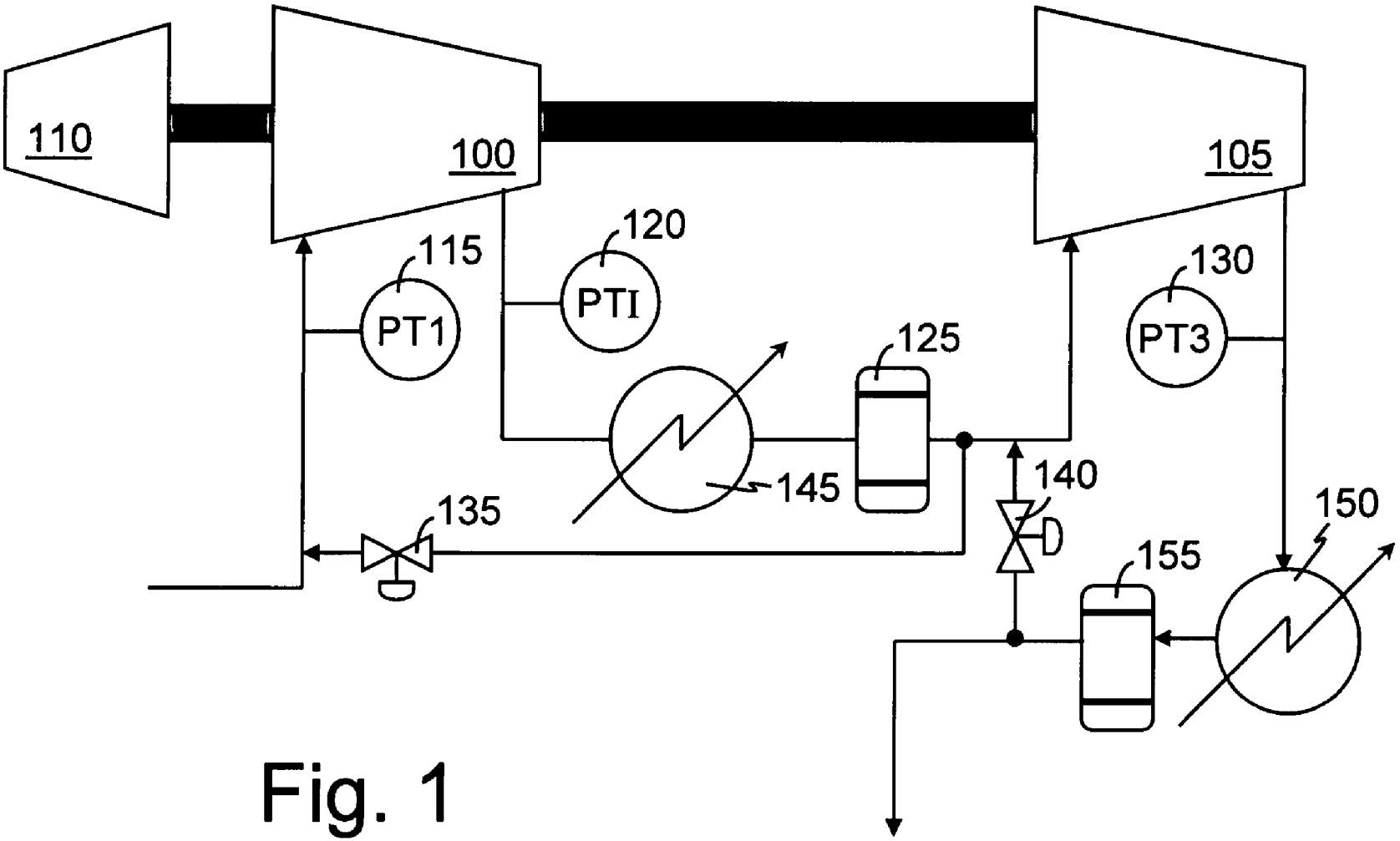
FIG. 1 shows a representative compression system and instrumentation.

A typical two-stage compression system is shown in FIG. 1. The two turbocompressors 100, 105, on a single shaft, are driven by a single gas or steam turbine 110. A suction pressure transmitter, PT1 115, is provided in the suction of the first compression stage 100. An interstage pressure transmitter, PT1 120, is used to measure a pressure between the compression stages 100, 105, preferably located to measure the highest pressure found in the interstage, or the pressure in an interstage vessel 125 having a maximum pressure constraint. The discharge pressure is measured by a discharge pressure transmitter, PT3 130. Any of these pressures may require limit control to keep them within predetermined bounds.

Antisurge valves 135, 140 may be used as manipulated variables, M, for limit control of several limited variables. The low pressure stage's 100 antisurge valve 135 can be used to keep the turbocompressor's 100 operating point in a stable operating region, that is, out of the surge region. The same antisurge valve 135 may be used to keep the suction pressure of the first compression stage 100 from dropping below a minimum suction pressure limit. It may also be used to keep the interstage pressure from exceeding a maximum interstage pressure limit.

Similarly, the high pressure stage's 105 antisurge valve 140 may be used to keep the second compression stage's 105 operating point from entering into its surge region. The same high-pressure antisurge valve may be used to keep the discharge pressure from exceeding a maximum limit.

An intercooler 145 serves to reduce the temperature of the compressed gas leaving the first compression stage 100 before it reaches the second compression stage 105. The interstage vessel 125 may serve as a knockout drum, permitting liquids to be separated from gases and removed from the stream.

An aftercooler 150 is found in many compression systems. Again, a knockout drum 155 may be necessary downstream of the aftercooler 150 to remove liquids condensed from the gas.

Figure 2:
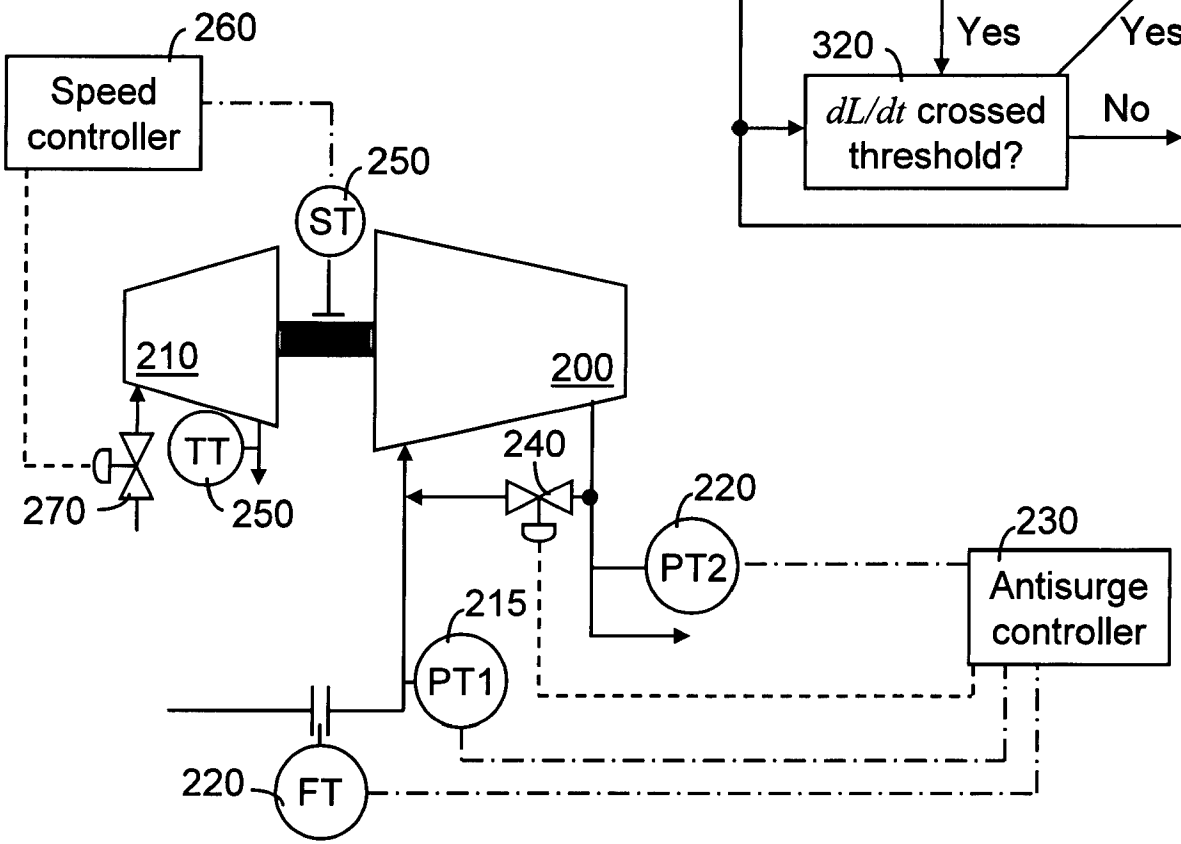
FIG. 2 shows a turbine driven turbocompressor with instrumentation and a control system.

A single turbocompressor 200 is shown being driven by a steam turbine 210 in FIG. 2. Instrumentation for antisurge and speed control is shown. At the suction of the turbocompressor 200, a flow transmitter, FT 220, and a suction pressure transmitter, PT1 215, are shown. At the turbocompressor's 200 discharge, a pressure transmitter, PT2 220, is shown. Each of these transmitters sends a signal to an antisurge controller 230 that manipulates an antisurge valve 240 to keep the turbocompressor's 200 operating point from entering surge.

Secondary control may be implemented in the antisurge controller 230 to limit the suction pressure and/or the discharge pressure to acceptable levels using the antisurge valve 240 as a manipulated variable, M.

A speed pickup and transmitter, ST 250, is used by the speed controller 260 to regulate the steam turbine's 210 rotational speed. To accomplish this, the speed controller 260 manipulates the steam turbine's 210 steam valve or rack 270. The speed controller will serve to keep the turbine's 210 rotational speed between upper and lower bounds, therefore, speed control is inherently constraint control.

Figure 3:
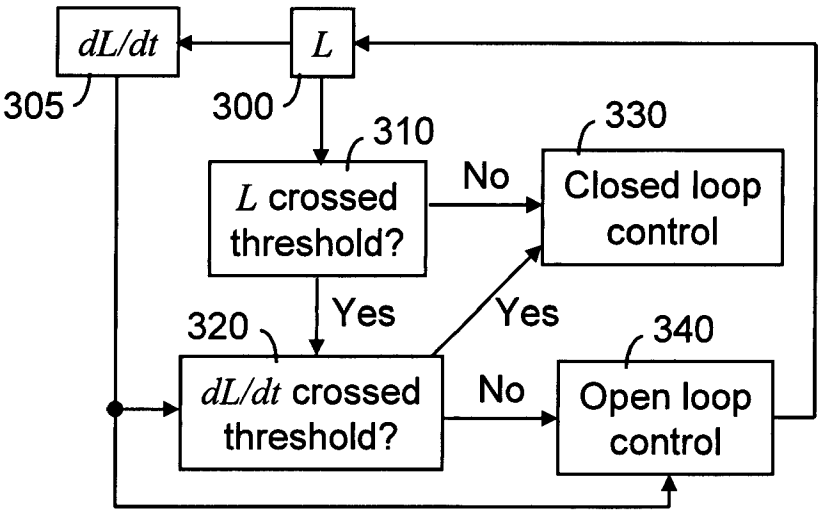
FIG. 3 shows a flow diagram of the present invention.

Closed and open loop limit control strategies must be coordinated to avoid oscillations. The flow diagram of FIG. 3 shows the interaction. The limit variable, L 300, such as a turbocompressor 200 suction pressure, is compared to an open loop threshold in a first comparator block 310, which may be an upper bound or a lower bound. Using the example of a suction pressure as L 300, the threshold would be a lower bound. That is, the turbocompressor's 200 suction pressure should remain greater than or equal to the threshold value, which is, typically, slightly above atmospheric pressure.

The first temporal derivative of L 300, dL/dt is calculated in a derivative block 305. If the value of the limit variable, L 300, has crossed the threshold, a check is made on the value of dL/dt in a second comparator block 320. The value and sign of dL/dt helps to determine if the system is on the way to recovery, even if the value of L has not been restored to an acceptable value. For instance, let the turbocompressor's 200 suction pressure drop below its minimum limit, noting that $dL/dt=dp_s/dt$ (where $p_s$ is the turbocompressor's 200 suction pressure). If dL/dt is found to be positive, that is, the suction pressure is increasing, it is concluded that the suction pressure is responding to the control action. Measuring the magnitude of dL/dt, as well, yields a measure of the rate of recovery. So, after open loop control action has been initiated, even if L has not been restored to a safe level, if dL/dt has a sign and, optionally, a magnitude indicating recovery, and the magnitude indicates an acceptable rate of recovery, limit control of L may be passed back to closed loop control 330 as indicated in FIG. 3. If the magnitude and/or sign of dL/dt do not meet the threshold requirements of the second comparator block 320, open loop control 340 is again initiated.

Figure 4:
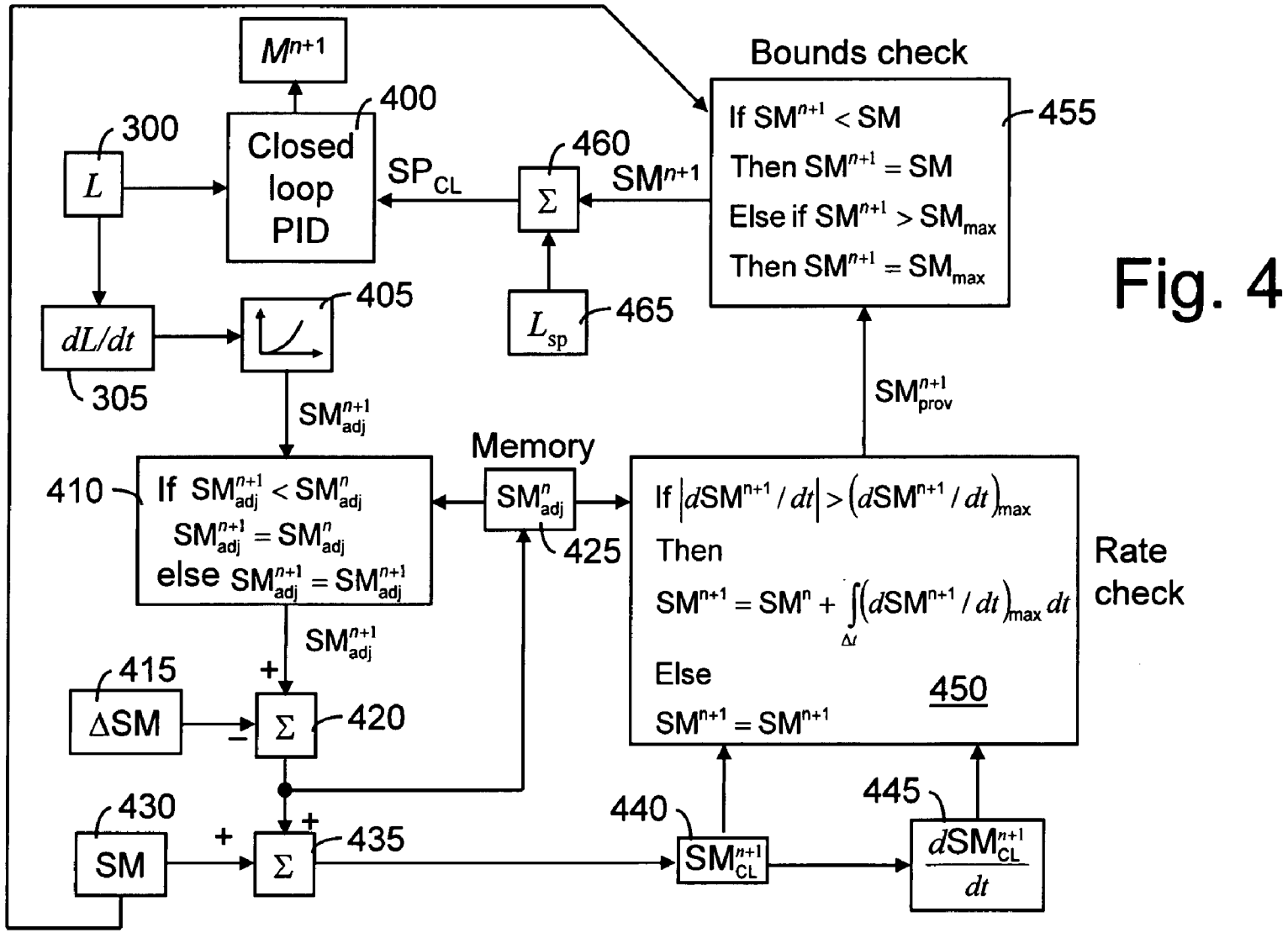
FIG. 4 shows a block diagram of the closed loop limit control set point calculation.

The closed loop control scheme is shown in more detail in FIG. 4. A value of L 300 is obtained from a transmitter or calculation and passed to the closed loop Proportional-Integral-Derivative (PID) limit controller 400 as its limit control process variable. The remainder of FIG. 4 represents the calculations used to determine an appropriate set point for the closed loop PID limit controller 400.

The critical limit variable, L 300, is also an input to the derivative block 305, where the first temporal derivative, dL/dt is calculated. A function of the derivative, dL/dt, is calculated in a function block 405. An example of such a function is simply proportionality. The present invention is not limited to a particular function.

The output of the function block 405 is shown in FIG. 4 as being an adjustment for the safety margin, $SM_{adj}^{n+1}$, or an accumulated safety margin. Another possibility is for the output of the function block 405 to be a set point; however, for explanation purposes, a safety margin has the advantage of being strictly positive (so, if we add to the safety margin, the control is more conservative).

When additional safety margin has been added to a minimum safety margin, as the danger passes, the additional safety margin is reduced at a predetermined rate or rates.

Therefore, a check is made in a logic block 410 to assure the newly calculated accumulated safety margin, $SM_{adj}^{n+1}$, is not smaller than the accumulated safety margin, $SM_{adj}^{n}$, calculated at the previous scan. If the new accumulated safety margin, $SM_{adj}^{n+1}$, is found to be smaller than the previous accumulated safety margin, $SM_{adj}^{n}$, the new accumulated safety margin, $SM_{adj}^{n+1}$, is set to the old value, $SM_{adj}^{n}$ in the logic block 410.

To effect the reduction of an accumulated safety margin, $SM_{adj}^{n+1}$, a constant or variable value, ΔSM 415, is subtracted from the accumulated safety margin in a first summation block 420. A constant value of ΔSM 415 will result in a ramping of the accumulated safety margin, $SM_{adj}^{n+1}$. Another viable possibility is an exponential decay. The present invention is not limited to a particular method of reducing an accumulated safety margin, $SM_{adj}^{n+1}$.

The instantaneous value of the accumulated safety margin, $SM_{adj}^{n+1}$, is stored in a memory block 425 as the old value of the accumulated safety margin, $SM_{adj}^{n}$, to be used in the next scan of this process.

The accumulated safety margin, $SM_{adj}^{n+1}$, is added to a minimum safety margin, SM 430, in a second summation block 435. The result is the closed loop safety margin, $SM_{CL}^{n+1}$ 440. The value of $SM_{CL}^{n+1}$ 440, and its first temporal derivative, $dSM_{CL}^{n+1}/dt$ 445 are passed into a rate check block 450 where the speed at which the safety margin can change is limited.

A provisional safety margin, $SM_{prov}^{n+1}$, results from the rate check block 450. This provisional safety margin, $SM_{prov}^{n+1}$, is checked for magnitude in the bounds check block 455. In the bounds check block 455, the magnitude of the safety margin may be bounded both above and below. The result of the bounds check block 455 is the final value of the safety margin, $SM^{n+1}$, which is summed with the closed loop set point $L_{sp}$ 465 in a third summation block 460 to produce a closed loop set point $SP_{CL}$ utilized by the closed loop PID 400.

Figure 5:
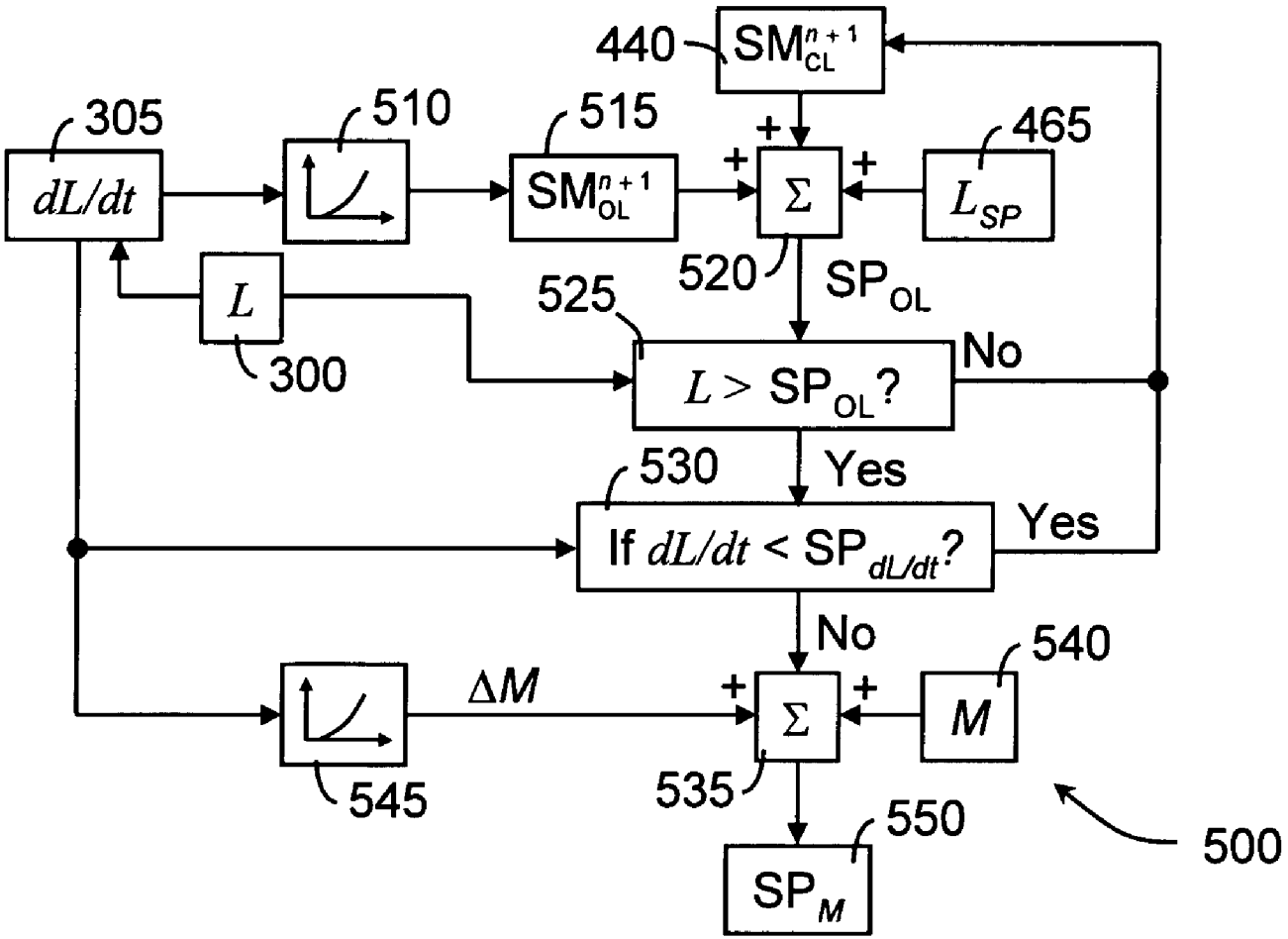
FIG. 5 shows a block diagram of the open loop limit control manipulated variable set point calculation when the limit set point is an upper limit.
Figure 6:
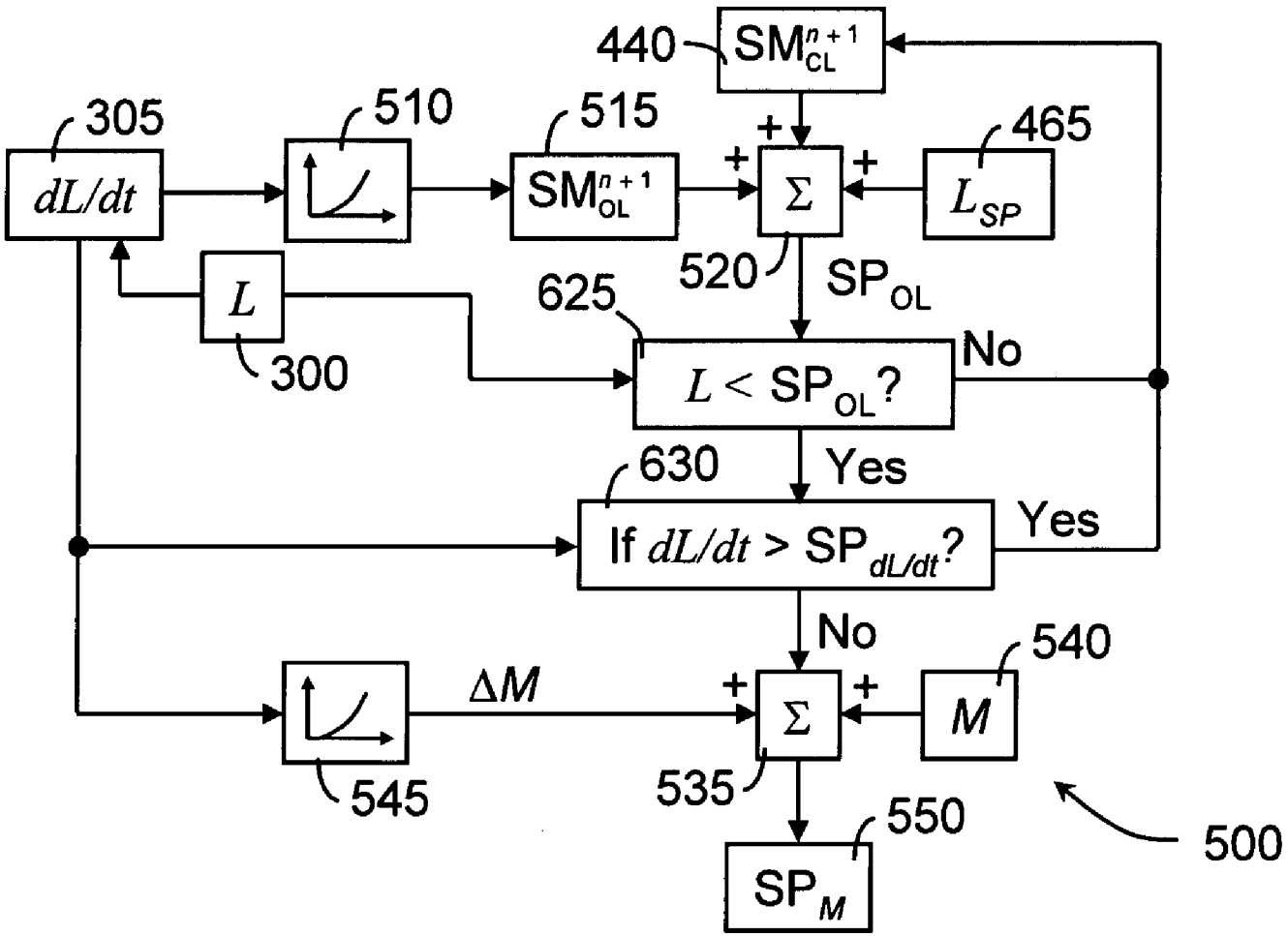
FIG. 6 shows a block diagram of the open loop limit control manipulated variable set point calculation when the limit set point is an lower limit.

Flow diagrams illustrating the operation of the open loop limit controller are shown in FIGS. 5 and 6. In FIG. 5, it is assumed that the limit on L 300 is an upper limit while in FIG. 6, the limit on L 300 would be a lower limit.

The value of L 300 and its set point, $L_{SP}$ 465, must be made available to the open loop control system 500. Again, a first derivative with respect to time, dL/dt is taken of the limit variable, L 300, in a derivative block 305. The value of dL/dt from the derivative block 305 is used in a first function block 510 to calculate a value for an instantaneous open loop safety margin, $SM_{OL}^{n+1}$ 515. A first summation block 520 sums the instantaneous closed loop safety margin, $SM_{CL}^{n+1}$ 440, the instantaneous open loop safety margin, $SM_{OL}^{n+1}$ 515, and the base set point for L 300, $L_{SP}$ 465. The result is a value of the open loop set point, $SP_{OL}$. In a first comparator block 525, 625, the value of L 300 is compared with the set point $SP_{OL}$ to determine if open loop action is required. If this test indicates open loop action is not needed, the process begins anew. If it appears as if open loop action is required, another test is carried out in a second comparator block 530, 630. Here, it is determined if the sign of the first derivative of L 300 from the derivative block 305 is negative (positive in FIG. 6), indicated a recovery from the limit condition, and that the magnitude of the rate of change is greater than a set point, $SP_{dL/dt}$. This test indicates whether the system is recovering satisfactorily, and that open loop (or additional open loop) action is not required. Again, if recovery seems imminent, the process begins anew and control is passed to the closed loop limit control system. If the result of this test in the second comparator block 530 is "No," the flow continues to a second summation block 535 where the present value of the manipulated variable (for instance, a valve position), M 540 is summed with an open loop increment, ΔM (calculated in a second function block 545 as a function of dL/dt), to yield a new set point, $SP_M$ 550, for the manipulated variable.

Figure 7:
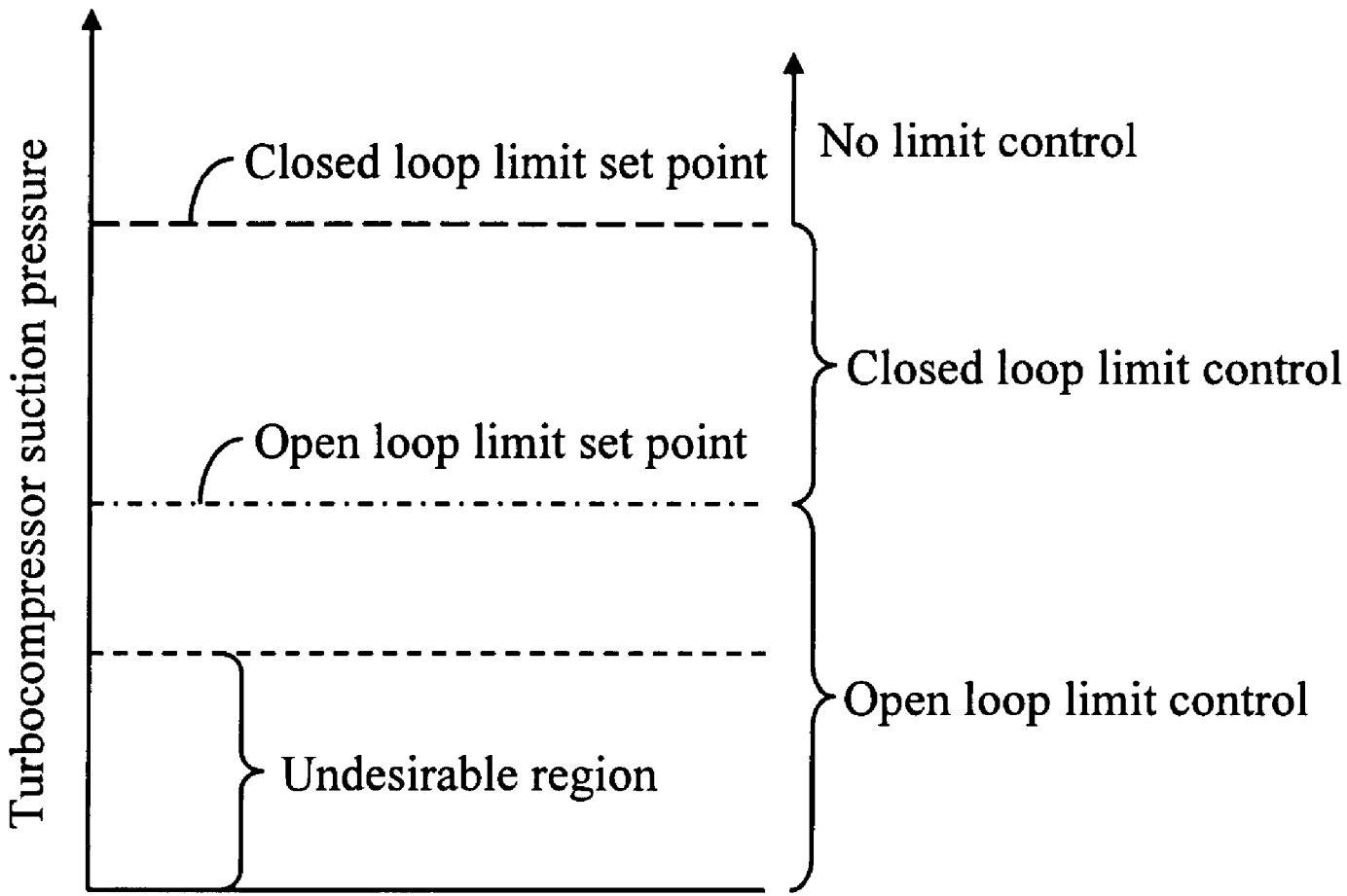
FIG. 7 shows a relationship between the open loop and closed loop limit set points and an undesirable region in which limit control is exercised.

FIG. 7 illustrates the relative locations of the open loop and closed loop limit set points and the undesirable region in which limit control should be in force. The example used is that of turbocompressor suction pressure, which has a low limit. That is, the turbocompressor's suction pressure should remain greater than a chosen limit.

Figure 8:
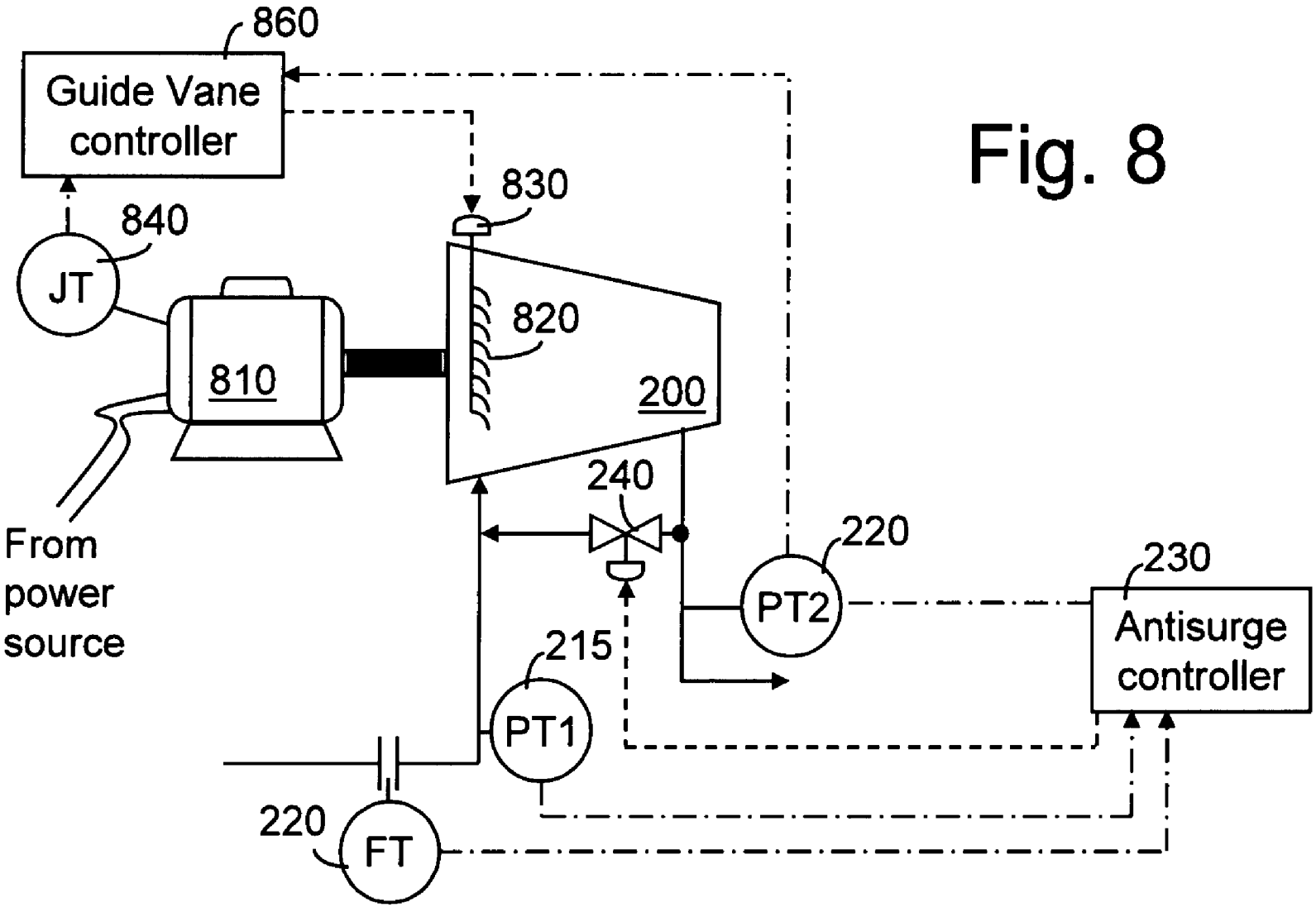
FIG. 8 shows an electric driven turbocompressor with variable inlet guide vanes, instrumentation, and a control system.

Another configuration of compressor/driver is shown in FIG. 8, wherein the compressor 200 is driven by an electric motor 810. Such electric motors 810 may be variable speed, but most commonly are constant speed. Capacity or performance control is carried out using guide vanes such as variable inlet guide vanes 820 shown. The variable guide vanes are manipulated via an actuator 830 by the guide vane controller 860 to maintain a suction pressure, discharge pressure or flow rate (typically) at a set point. A possible limit variable, maintained in a safe operating region by limit control, is the electric motor power, J, as measured by the power transmitter 840. Motor power may require limiting from above.

Figure 9:
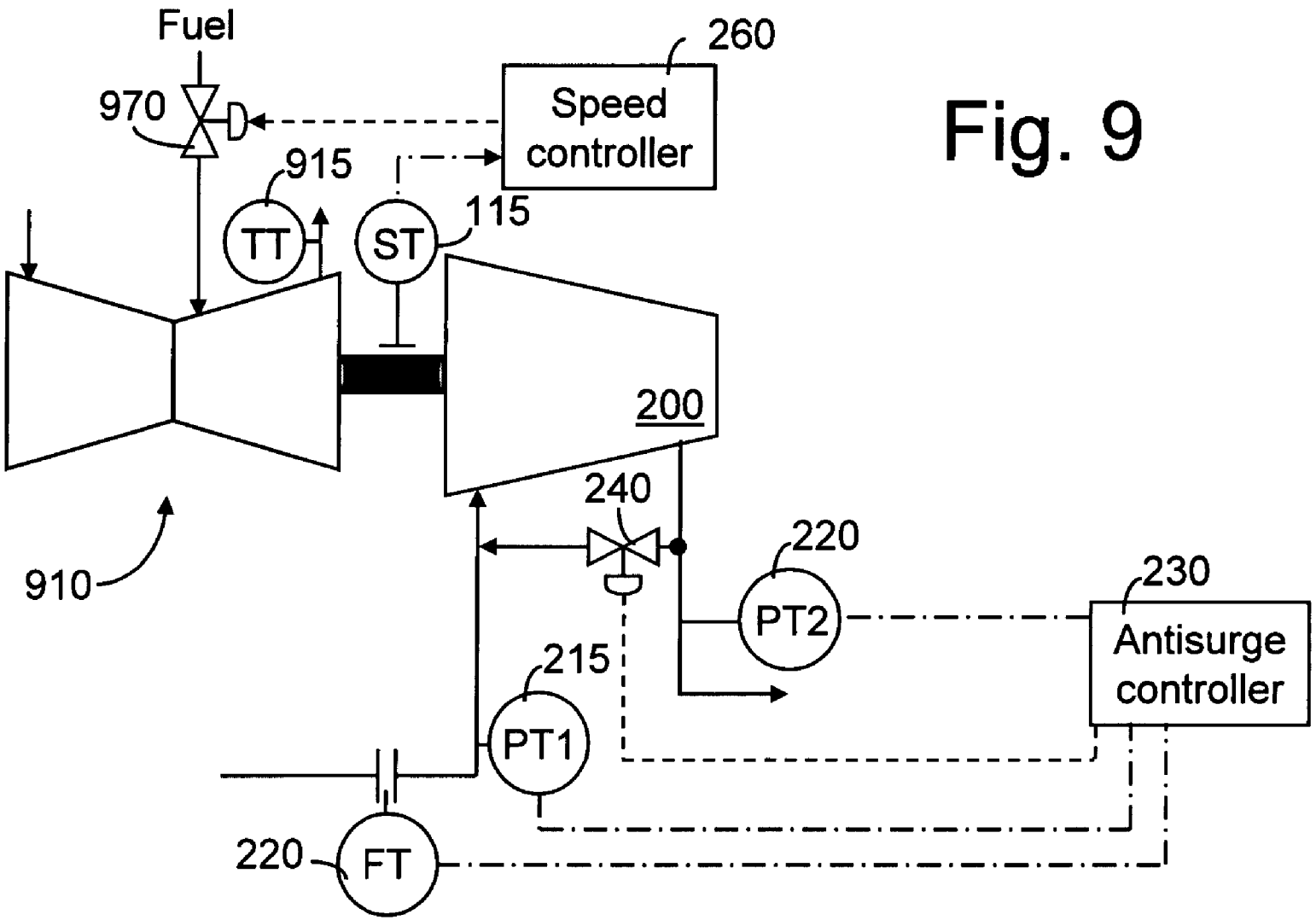
FIG. 9 shows a gas-turbine driven turbocompressor with instrumentation and a control system.

Still another compressor/driver combination is shown in FIG. 9 wherein the driver is a single or multiple shaft gas turbine 910. A speed controller 260 is, again, used. A limit control loop may be incorporated within the speed controller 260 for the purpose of limiting an exhaust gas temperature as measured and reported by the exhaust gas temperature sensor 915. Reducing a flow of fuel by reducing the opening of the fuel valve 970 causes the exhaust gas temperature to lower.

In FIGS. 10*a*-10*e* various values, reported by sensors, are shown being used as limit variables, L. The instant invention is not limited to the values shown in these figures.

Figure 10A:
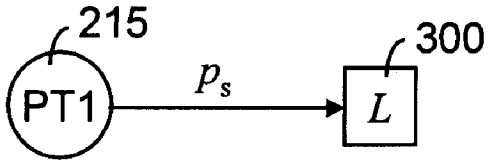
FIG. 10*a* shows a suction pressure transmitter providing a suction pressure signal for use as a limit variable.
Figure 10B:
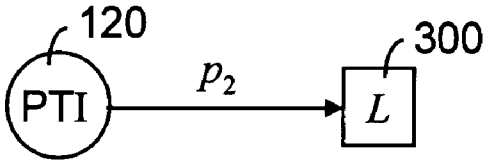
FIG. 10*b* shows an interstage pressure transmitter providing a interstage pressure signal for use as a limit variable.
Figure 10C:
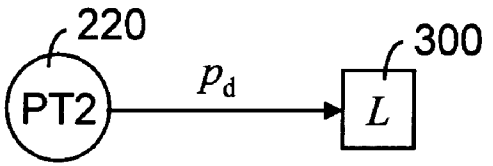
FIG. 10*c* shows a discharge pressure transmitter providing a discharge pressure signal for use as a limit variable.
Figure 10D:
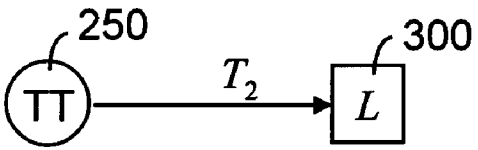
FIG. 10*d* shows a discharge steam temperature transmitter providing a discharge steam temperature signal for use as a limit variable.
Figure 10E:
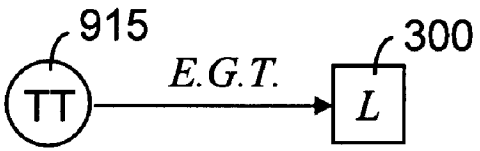
FIG. 10*e* shows a, exhaust gas temperature transmitter providing a exhaust gas temperature signal for use as a limit variable.

In FIG. 10*a*, a turbocompressor's suction pressure, $p_s$, is transmitted by a suction pressure transmitter, PT1 215, to be used as a limit variable, L 300, as shown in FIGS. 3-6. In FIG. 10*b*, the limit variable is turbocompressor interstage pressure, $p_2$. In FIG. 10*c*, the limit variable is turbocompressor discharge pressure, $p_d$. In FIG. 10*d*, the limit variable is steam turbine discharge pressure, $T_2$. Finally, in FIG. 10*e*, the limit variable is the Exhaust Gas Temperature (E.G.T.) of a gas turbine.

The above embodiment is the preferred embodiment, but this invention is not limited thereto. It is, therefore, apparent that many modifications and variations of the present invention are possible in light of the above teachings. It is, therefore, to be understood that within the scope of the appended claims, the invention may be practiced otherwise than as specifically described.

We claim:

1. An apparatus for providing limit control, not antisurge control, of a compression process having a limit variable, L, values of said limit variable being divided into a first region wherein closed loop limit control is used and a second region in which open loop limit control is used, the apparatus comprising:

(a) a first calculator for calculating the value of the limit variable, L, based on parameters associated with a turbocompressor;

(b) a closed loop limit controller in effect when the value of the limit variable, L, is in the first region; and (c) an open loop limit controller in effect when the value of the limit variable, L, is in the second region.

2. The apparatus of claim 1 including means to return control to the closed loop controller when the value of a limit variable, L, returns in the first region.

3. The apparatus of claim 1 wherein the open loop limit controller comprises means for changing a value of a manipulated variable as quickly as possible a predetermined increment.

4. The apparatus of claim 3 including a second calculator for determining a variable predetermined increment during operation.

5. The apparatus of claim 1 including a suction pressure sensor for sensing a suction pressure of the turbocompressor as the limit variable, L.

6. The apparatus of claim 1 including a discharge pressure sensor for sensing a discharge pressure of the turbocompressor as the limit variable, L.

7. The apparatus of claim 1 wherein the turbocompressor comprises a plurality of stages and the apparatus additionally comprises an interstage pressure sensor for sensing an interstage pressure of the turbocompressor as the limit variable, L.

8. A apparatus for providing limit control of a process having a limit variable, L, values of said limit variable being divided into a first region wherein closed loop limit control is used and a second region in which open loop limit control is used, the apparatus comprising:

(a) an open loop limit controller, in effect when the value of a limit variable, L, is in the second region;

(b) a derivative calculator for calculating a value of a first temporal derivative, dL/dt, of the limit variable, L; and (c) a closed loop limit controller in effect if the value of the first temporal derivative, dL/dt, has a sign indicating the value of L is changing toward the first region.

9. The apparatus of claim 8 wherein the values of the limit variable, L, are divided into three regions: a first region wherein closed loop limit control is used and a second region in which open loop limit control is used, and a third region wherein no limit control is required, the apparatus additionally comprising:

(a) means for setting a closed loop limit control set point in a neighborhood of a boundary between the first and third regions;

(b) means for setting an open loop limit control set point toward the second region relative to the closed loop limit control set point; and (c) an open loop limit controller in effect when a value of a limit variable, L, is at the open loop limit control set point or on an opposite side of the open loop limit control set point relative to the closed loop limit control set point.

10. The apparatus of claim 8 additionally comprising a comparator for testing a magnitude of dL/dt before providing closed loop limit control.

11. The apparatus of claim 8 additionally comprising a function calculator for determining a set point for the closed loop limit controller as a function of dL/dt.

12. The apparatus of claim 8 additionally comprising a function calculator for determining a set point for the open loop limit controller as a function of dL/dt.

13. The apparatus of claim 10 additionally comprising a logic function for bounding a set point for the closed loop limit controller.

14. The apparatus of claim 11 additionally comprising a logic function for bounding a set point for the open loop limit controller.

15. The apparatus of claim 8 additionally comprising a manipulated variable, M, adjusted to control the value of the limit variable, L.

* * * * *